US010159390B2

(12) United States Patent
Wilcox

(10) Patent No.: US 10,159,390 B2
(45) Date of Patent: Dec. 25, 2018

(54) UMBRELLA ACCESSORIZING PAPER TOWEL DISPENSER

(71) Applicant: Karen Wilcox, Fort Meyers, FL (US)

(72) Inventor: Karen Wilcox, Fort Meyers, FL (US)

( * ) Notice: Subject to any disclaimer, the term of this patent is extended or adjusted under 35 U.S.C. 154(b) by 327 days.

(21) Appl. No.: 14/959,173

(22) Filed: Dec. 4, 2015

(65) Prior Publication Data

US 2017/0156457 A1 Jun. 8, 2017

(51) Int. Cl.

| | |
|---|---|
| ***A47K 10/38*** | (2006.01) |
| ***B65H 75/16*** | (2006.01) |
| ***B65H 16/00*** | (2006.01) |
| ***A45B 9/00*** | (2006.01) |
| ***A47K 10/32*** | (2006.01) |

(52) U.S. Cl.

CPC ..... *A47K 10/3827* (2013.01); *A47K 10/38* (2013.01); *B65H 16/005* (2013.01); *B65H 75/16* (2013.01); *A45B 2009/002* (2013.01); *A47K 2010/3233* (2013.01); *A47K 2010/389* (2013.01)

(58) Field of Classification Search

CPC .. A47K 10/38; A47K 10/289; A47K 10/3827; A45B 2009/002; A45B 3/00; A45B 3/10; A45B 9/00; A45B 2200/1009; A45B 2200/1054; A45B 2025/003; B65H 75/16; B65H 75/185; B65H 16/005

USPC ..... 242/588.6, 597.7, 598.6; 135/16, 66, 98

See application file for complete search history.

(56) References Cited

U.S. PATENT DOCUMENTS

| | | | | |
|---|---|---|---|---|
| 2,480,461 | A * | 8/1949 | Gabrielson | B65H 16/005 242/578.2 |
| 4,487,376 | A | 12/1984 | Compton | |
| 4,898,335 | A | 2/1990 | Eysink | |
| D306,809 | S | 3/1990 | Joseph | |
| 5,502,848 | A | 4/1996 | Cowan | |
| D373,918 | S | 9/1996 | Joergensen | |
| 5,934,634 | A | 8/1999 | Lindblom | |
| 6,736,358 | B2 | 5/2004 | Johnson | |
| 8,640,894 | B1 * | 2/2014 | Cronin | A47B 97/00 108/183 |
| 8,662,433 | B2 * | 3/2014 | Huffman | B65D 5/0254 242/129 |
| 2002/0148748 | A1 * | 10/2002 | Pikul | A47K 10/3827 206/409 |
| 2015/0001332 | A1 * | 1/2015 | Qin | B65H 16/005 242/598.3 |

OTHER PUBLICATIONS

Burnes, Laurie, "Use Umbrella Stand for Paper Towel Holder!", Acessed Mar. 22, 2018, https://www.pinterest.com/197595502376099259/. (Year: 2018).*

* cited by examiner

*Primary Examiner* — William E Dondero

(57) ABSTRACT

An umbrella accessorizing paper towel dispenser for accessorizing an umbrella includes a casing that comprises a base. A shell is coupled to and extends upwardly from a perimeter of the base, defining an open top. The dispenser includes a lid that is complimentary to and reversibly couplable to the open top. A slot, configured for protrusion of a free end of the roll of paper towels, is positioned longitudinally in the shell between the base and the open top. A coupler is coupled to the casing. The coupler is configured to reversibly couple the casing to the tube of an umbrella.

11 Claims, 5 Drawing Sheets

UMBRELLA ACCESSORIZING PAPER TOWEL DISPENSER

BACKGROUND OF THE DISCLOSURE

Field of the Disclosure

The disclosure relates to paper towel dispensers and more particularly pertains to a new paper towel dispenser for accessorizing an umbrella.

SUMMARY OF THE DISCLOSURE

An embodiment of the disclosure meets the needs presented above by generally comprising a casing that comprises a base. A shell is coupled to and extends upwardly from a perimeter of the base, defining an open top. The dispenser includes a lid that is complimentary to and reversibly couplable to the open top. A slot, configured for protrusion of a free end of the roll of paper towels, is positioned longitudinally in the shell between the base and the open top. A coupler is coupled to the casing. The coupler is configured to reversibly couple the casing to the tube of an umbrella.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
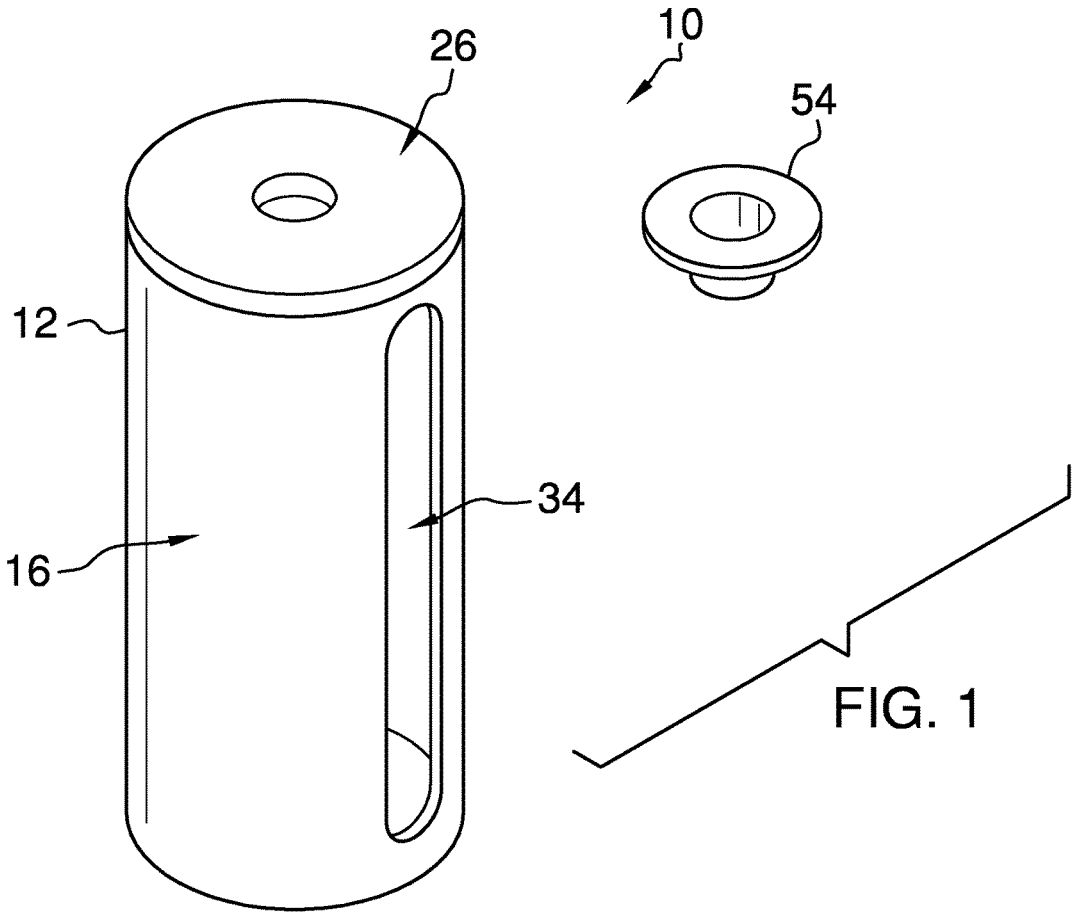
FIG. 1 is an isometric perspective view of an umbrella accessorizing paper towel dispenser according to an embodiment of the disclosure.
Figure 2:
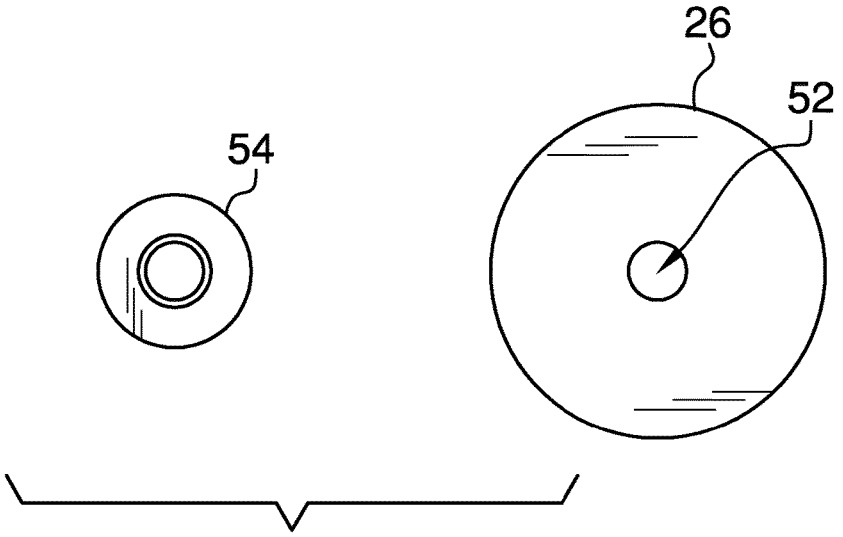
FIG. 2 is a bottom view of an embodiment of the disclosure.
Figure 3:
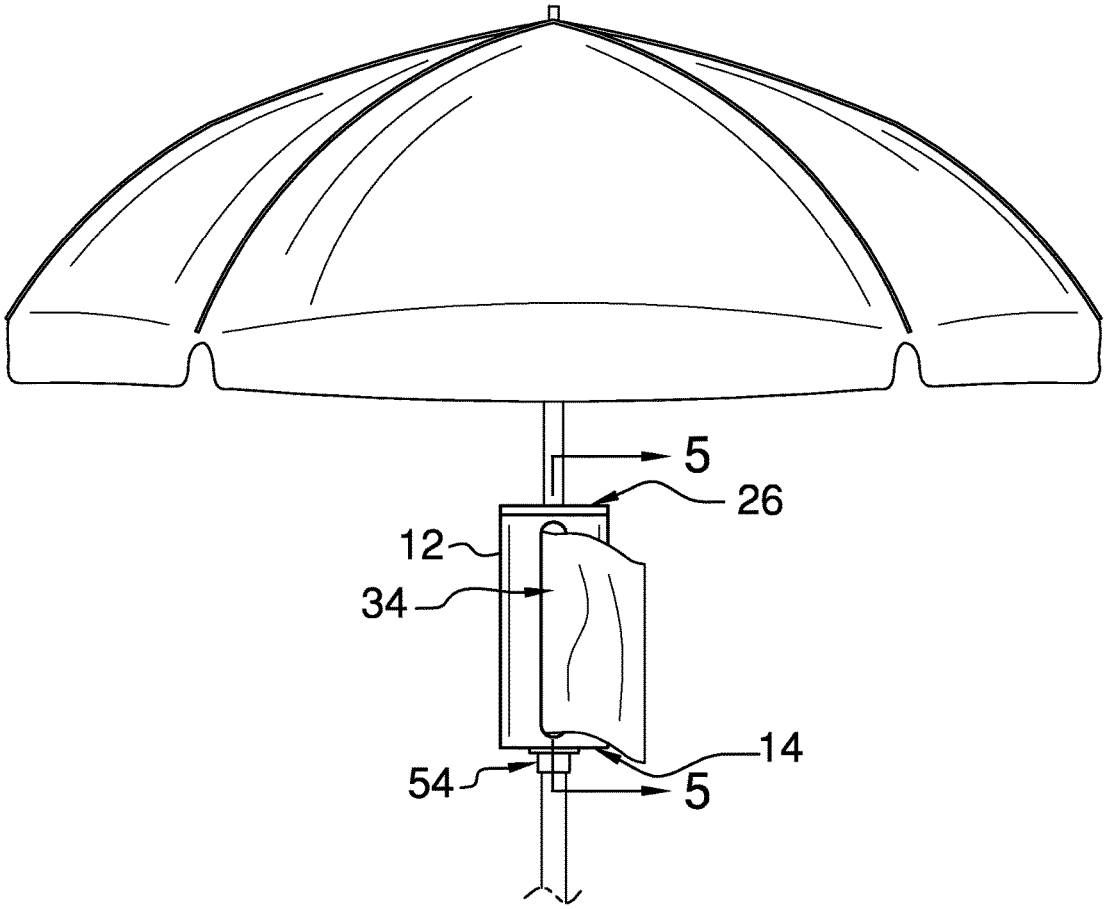
FIG. 3 is an in-use view of an embodiment of the disclosure.
Figure 4:
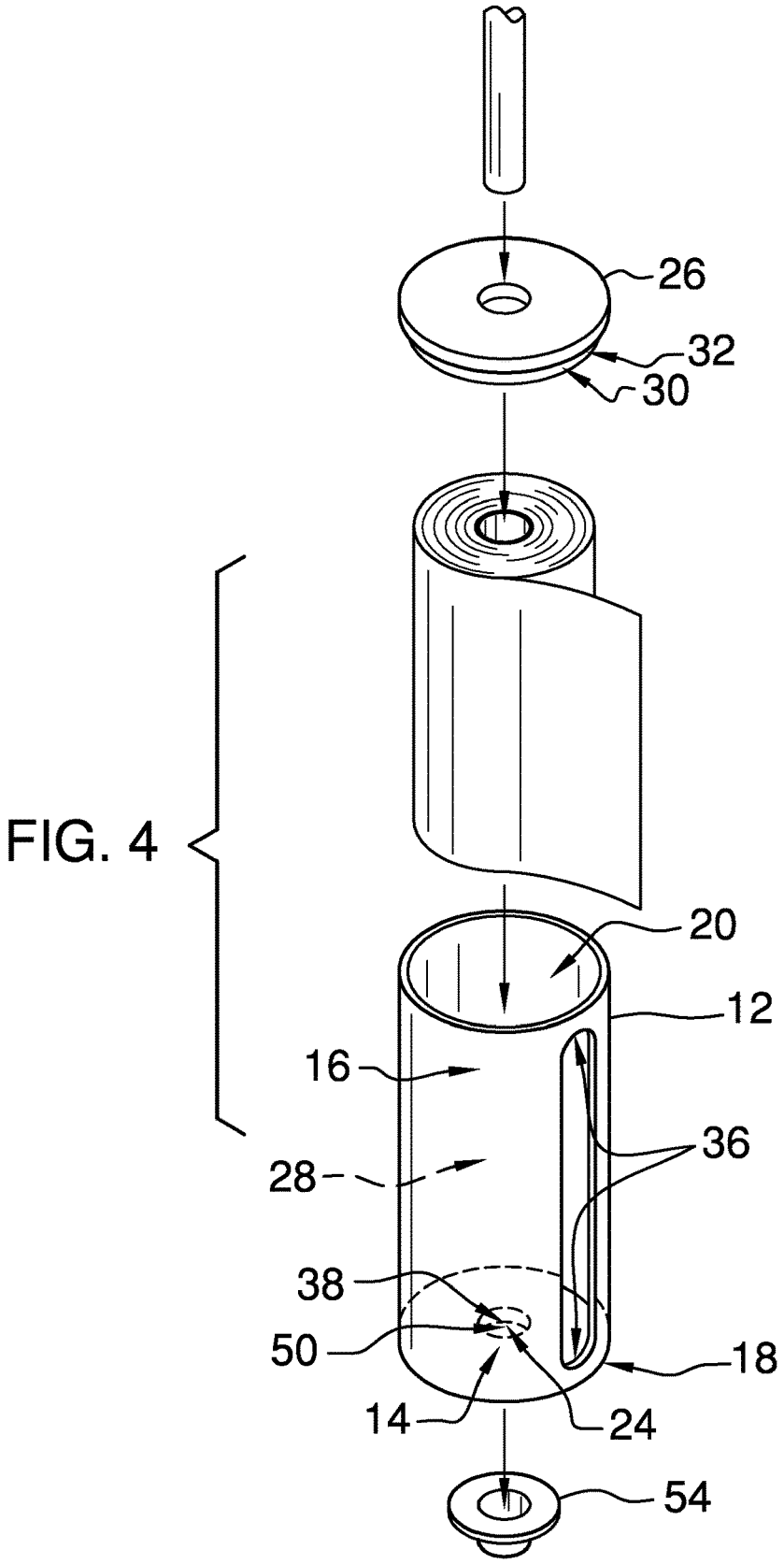
FIG. 4 is an exploded view of an embodiment of the disclosure.
Figure 5:
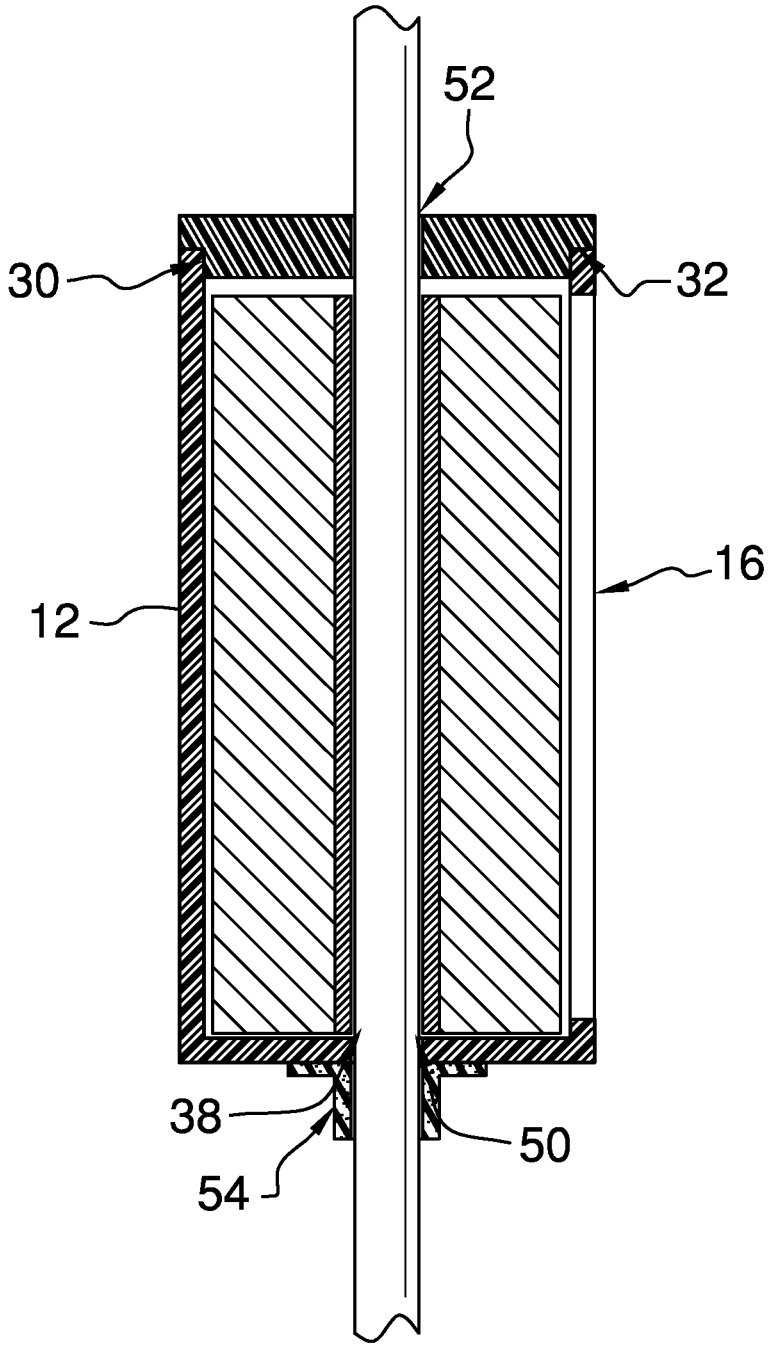
FIG. 5 is a cross-sectional view of an embodiment of the disclosure.
Figure 6:
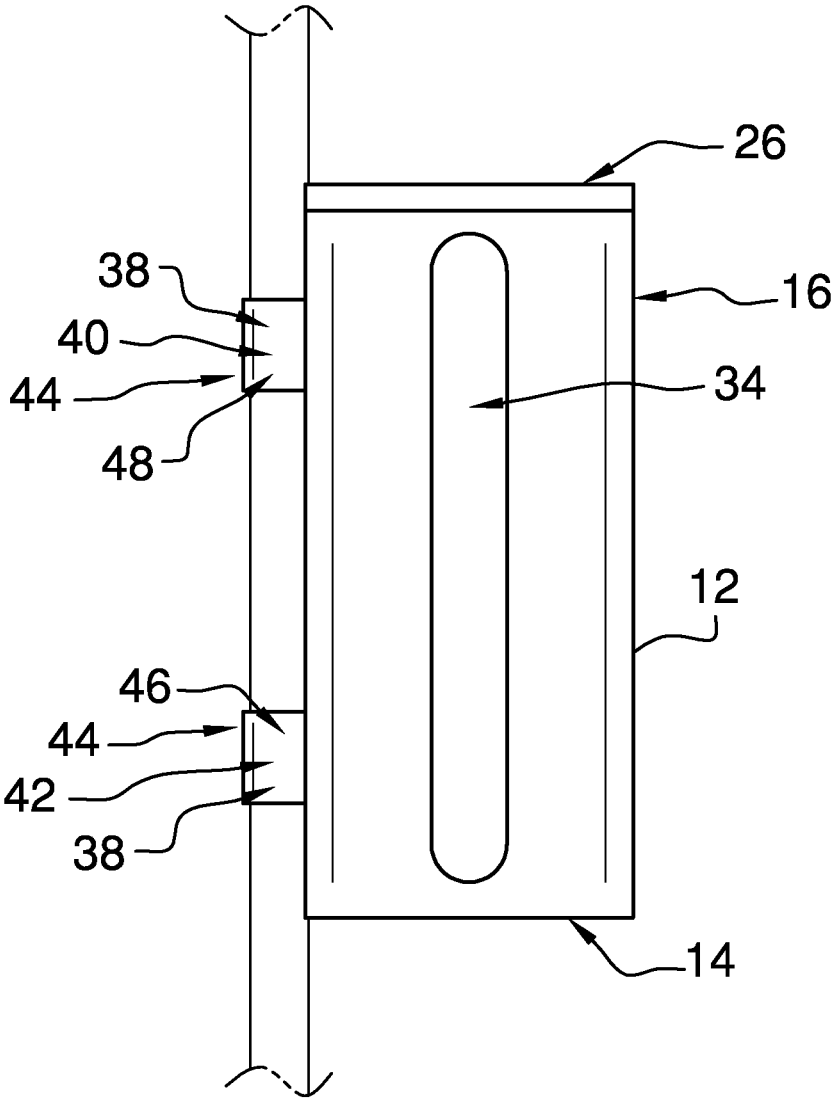
FIG. 6 is an in-use view of an embodiment of the disclosure.

With reference now to the drawings, and in particular to FIGS. 1 through 6 thereof, a new paper towel dispenser embodying the principles and concepts of an embodiment of the disclosure and generally designated by the reference numeral 10 will be described.

As best illustrated in FIGS. 1 through 6, the umbrella accessorizing paper towel dispenser 10 generally comprises a casing 12 that comprises a base 14. A shell 16 is coupled to and extends upwardly from a perimeter 18 of the base 14, defining an open top 20. Preferably, the base 14 is circular, such that the shell 16 is cylindrical.

The dispenser 10 includes a lid 26 that is complimentary to and reversibly couplable to the open top 20. The open top 20 is configured for insertion of a roll of paper towels into an interior space 28 defined by the shell 16 and the base 14. The lid 26 is positionable in the open top 20 to contain the roll of paper towels in the interior space 28. Preferably, the lid 26 has an inset 30 that defines a ridge 32. The inset 30 is positioned for insertion into the open top 20 with the ridge 32 engaging the shell 16 to cover the open top 20.

A slot 34 is positioned longitudinally in the shell 16 between the base 14 and the open top 20. The slot 34 is configured for protrusion of a free end of a roll of paper towels positioned in the interior space 28. Preferably, the slot 34 extends from proximate to the open top 20 to proximate to the base 14 and has opposing ends 36 that are rounded.

A coupler 38 is coupled to the casing 12. The coupler 38 is configured to reversibly couple the casing 12 to the tube of an umbrella. Preferably, the coupler 38 is coupled to the casing 12 such that coupling of the coupler 38 to the tube of the umbrella positions the slot 34 in substantial parallelism with the tube of the umbrella. In one embodiment of the invention, the coupler 38 comprises a first fastener 40 and a second fastener 42. The first fastener 40 is coupled to the shell 16 proximate to the open top 20. The second fastener 42 is coupled to the shell 16 proximate to the base 14. Preferably, the first fastener 40 and the second fastener 42 comprise straps 44. The straps 44 may comprise zip ties 46. Each strap 44 also may comprise a hook and loop fastener 48.

In another embodiment of the invention, the coupler 38 comprises a hole 50 that is centrally positioned in the base 14. A penetration 52, complimentary to the hole 50, is centrally positioned in the lid 26. The penetration 52 is configured for insertion of the upper tube of a two-piece umbrella into and through the cylinder of the roll of paper towels, such that the upper tube extends through the hole 50. The base 14 is configured to support the casing 12 on the lower tube of the two-piece umbrella. A flange 54 that is complimentary to and slidably couplable to the tube of an umbrella may be positioned on the tube to engage the base 14 to fix the casing 12 in a desired position on the tube. Preferably, the flange 54 is circular and comprises rubber.

In use, the open top 20 is positioned in the casing 12 for the user to insert a roll of paper towels into the interior space 28. The free end of the roll of paper towels is positioned through the slot 34 to allow the paper towel to be dispensed. The lid 26 then is positioned in the open top 20. The coupler 38 positioned on the casing 12 is coupled to the tube of an umbrella to secure the dispenser 10 to the umbrella.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An umbrella and accessorizing paper towel dispenser comprising:

an umbrella;

a casing, said casing comprising a base;

a shell, said shell being coupled to and extending upwardly from a perimeter of said base defining an open top;

a lid, said lid being complimentary to and reversibly couplable to said open top, wherein said open top is configured for insertion of a roll of paper towels into an interior space defined by said shell and said base, wherein said lid is positionable in said open top to contain the roll of paper towels in said interior space;

a slot, said slot being positioned longitudinally in said shell between said base and said open top, such that said slot is configured for protrusion of a free end of a roll of paper towels positioned in said interior space; and a coupler, said coupler being coupled to said casing, said coupler comprising a hole, said hole being centrally positioned in said base; and a penetration, said penetration being centrally positioned in said lid, said penetration being complimentary to said hole such that said penetration is configured for insertion of a tube of the umbrella, wherein the upper tube is positioned through the cylinder of the roll of paper towels and extends through said hole.

2. The dispenser of claim 1, further including said coupler being coupled to said casing such that coupling of said coupler to the tube of the umbrella positions said slot in substantial parallelism with the tube of the umbrella.

3. The dispenser of claim 1, further including said base being circular, such that said shell is cylindrical.

4. The dispenser of claim 1, further including said lid having an inset defining a ridge, such that said inset is positioned for insertion into said open top with said ridge engaging said shell to cover said open top.

5. The dispenser of claim 1, further including said slot extending from proximate to said open top to proximate to said base.

6. The dispenser of claim 1, further including said slot having opposing ends, said opposing ends being rounded.

7. The dispenser of claim 1, further including a flange, said flange being complimentary to and slidably couplable to the tube of the umbrella, wherein said flange is configured to be positioned on the tube to engage said base to fix said casing in a desired position on the tube.

8. The dispenser of claim 7, further including said flange being circular.

9. The dispenser of claim 7, further including said flange comprising rubber.

10. An umbrella and accessorizing paper towel dispenser comprising:

an umbrella;

a casing, said casing comprising a base;

a shell, said shell being coupled to and extending upwardly from a perimeter of said base defining an open top;

a lid, said lid being complimentary to and reversibly couplable to said open top, wherein said open top is configured for insertion of a roll of paper towels into an interior space defined by said shell and said base, wherein said lid is positionable in said open top to contain the roll of paper towels in said interior space;

a slot, said slot being positioned longitudinally in said shell between said base and said open top, such that said slot is configured for protrusion of a free end of a roll of paper towels positioned in said interior space;

a coupler, said coupler being coupled to said casing, said coupler being configured to reversibly couple said casing to a tube of the umbrella said coupler comprising a hole, said hole being centrally positioned in said base; a penetration, said penetration being centrally positioned in said lid, said penetration being complimentary to said hole, such that said penetration is configured for insertion of the tube of the umbrella, wherein the tube is positioned through the cylinder of the roll of paper towels and extends through said hole;

said coupler being coupled to said casing such that coupling of said coupler to the tube of the umbrella positions said slot in substantial parallelism with the tube of the umbrella;

said base being circular, such that said shell is cylindrical;

said lid having an inset defining a ridge, such that said inset is positioned for insertion into said open top with said ridge engaging said shell to cover said open top; and said slot extending from proximate to said open top to proximate to said base, said slot having opposing ends, said opposing ends being rounded.

11. The dispenser of claim 10, further comprising:

a flange, said flange being complimentary to and slidably couplable to the tube of an umbrella, wherein said flange is configured to be positioned on the tube to engage said base to fix said casing in a desired position on the tube; and said flange being circular, said flange comprising rubber.

* * * * *